US010011128B2

(12) United States Patent
Zhang et al.

(10) Patent No.: US 10,011,128 B2
(45) Date of Patent: Jul. 3, 2018

(54) PAPER DISCHARGING MECHANISM AND PRINTING DEVICE HAVING THE SAME

(71) Applicant: Shandong New Beiyang Information Technology Co., Ltd., Shandong (CN)

(72) Inventors: Zhengmin Zhang, Shandong (CN); Ning Feng, Shandong (CN); Shanhua Xu, Shandong (CN); Shuxun Dong, Shandong (CN)

(73) Assignee: Shandong New Beiyang Information Technology Co., Ltd., Beijing (CN)

( * ) Notice: Subject to any disclaimer, the term of this patent is extended or adjusted under 35 U.S.C. 154(b) by 0 days.

(21) Appl. No.: 15/506,633

(22) PCT Filed: Aug. 28, 2015

(86) PCT No.: PCT/CN2015/088441
§ 371 (c)(1),
(2) Date: Feb. 24, 2017

(87) PCT Pub. No.: WO2016/034083
PCT Pub. Date: Mar. 10, 2016

(65) Prior Publication Data

US 2017/0253057 A1 Sep. 7, 2017

(30) Foreign Application Priority Data

Sep. 5, 2014 (CN) ..... 2014 1 0458042

(51) Int. Cl.
*B41J 11/70* (2006.01)
*B41J 11/00* (2006.01)
*B41J 13/00* (2006.01)

(52) U.S. Cl.
CPC ..... *B41J 11/70* (2013.01); *B41J 11/0045* (2013.01); *B41J 13/0009* (2013.01)

(58) Field of Classification Search
CPC ..... B41J 11/00; B41J 11/0005; B41J 11/001; B41J 11/0025; B41J 11/003;
(Continued)

(56) References Cited

U.S. PATENT DOCUMENTS

2012/0162302 A1* 6/2012 Oguchi ..... B41J 13/0009 347/16

FOREIGN PATENT DOCUMENTS

CN 1672951 A 9/2005
CN 101093590 A 12/2007
(Continued)

OTHER PUBLICATIONS

English Language Translation of International Search Report for International Patent Application No. PCT/CN2015/088441 dated Dec. 3, 2015 (2 pages).

*Primary Examiner* — Kristal Feggins
(74) *Attorney, Agent, or Firm* — Wilmer Cutler Pickering Hale and Dorr LLP

(57) ABSTRACT

Disclosed are a paper discharging mechanism and printing device having the same. The paper discharging mechanism includes: a frame provided with a paper outlet thereon; a swinging rack, configured to be swingable relative to the frame; a conveying roller assembly provided on the swinging rack; a first drive assembly, which is in a transmission connection with the conveying roller assembly and configured to drive the same to deliver a paper to the paper outlet; a first detection assembly, configured to detect a position of the swinging rack relative to the frame; the swinging rack swings in a direction away from the paper outlet when the paper outlet is blocked.

20 Claims, 7 Drawing Sheets

(58) Field of Classification Search
CPC ... B41J 11/0035; B41J 11/004; B41J 11/0045; B41J 11/005; B41J 11/0055; B41J 11/006; B41J 11/0065; B41J 13/00; B41J 13/0009; B41J 13/0036; B41J 13/0027; B41J 13/0018; B41J 13/0054; B41J 13/0072; B41J 13/0063
See application file for complete search history.

(56) References Cited

FOREIGN PATENT DOCUMENTS

| | | | |
|---|---|---|---|
| CN | 102390184 | A | 3/2012 |
| CN | 102555536 | A | 7/2012 |
| CN | 202965525 | U | 6/2013 |
| CN | 203311505 | U | 11/2013 |
| EP | 1011974 | | 6/2000 |

* cited by examiner

PAPER DISCHARGING MECHANISM AND PRINTING DEVICE HAVING THE SAME

CROSS-REFERENCES TO RELATED APPLICATIONS

This application is a United States national phase application of co-pending international patent application number PCT/CN2015/088441, filed on Aug. 28, 2015, which claims priority to a Chinese patent application No. 201410458042.X filed on Sep. 5, 2014, disclosures of both of which are incorporated herein by reference in their entireties.

TECHNICAL FIELD

The present disclosure relates to a paper discharging mechanism and a printing device having the same.

BACKGROUND

Self-service terminal apparatuses have been widely used in various fields. A self-service terminal apparatus is usually provided with a printing device. For example, an automatic teller machine is capable of printing a transaction voucher, and a self-service machine for querying phone charge is capable of printing an itemized phone bill and the like. At present, a common problem of such self-service terminal apparatuses having a printing function lies in: paper is easily stacked at a paper outlet of the self-service terminal apparatus if the paper is prevented from being output by a user during printing, causing the printing device cannot perform next printing operation because the user cannot aware that paper is jammed between the paper outlet of the printing device and the paper outlet of the self-service terminal apparatus from the outside of the self-service terminal apparatus.

In order to solve the problem, China Patent Application No. 200820005246.8 provides a terminal apparatus for preventing paper jam. As illustrated in FIG. 1, the terminal apparatus for preventing paper jam includes a printing device 2' and a paper discharging mechanism 3'. The paper discharging mechanism 3' includes a lower passage plate 30', an upper passage plate 31' and a sensor 32'. The lower passage plate 30' and the upper passage plate 31' are arranged oppositely and spaced apart from each other so as to form a paper discharging passage. One end of the paper discharging passage is communicated with a paper outlet 20' of the printing device 2', and the other end is a paper outlet. The upper passage plate 31' is arranged in a "ㄇ" shape to form a protruding paper accommodation part 310'. The sensor 32' is fixed on the paper accommodation part 310'. After being output from the paper outlet 20' of the printing device 2', the paper enters the paper discharging passage of the paper discharging mechanism 3'. When delivering normally, the paper moves along a solid trail 'A' as illustrated in FIG. 1. When the paper outlet is blocked due to human or other factors, the paper moves along a dotted trail 'B' as illustrated in FIG. 1, and is stacked in the paper accommodation part 310' of the upper passage plate 31', and the paper discharging mechanism 3' sends out an alarm when the sensor 32' detects that there is a paper.

A problem of such paper discharging mechanism lies in: if a relative hard or thick paper (e.g. a paper the thickness of which is equal to or greater than 0.08 mm or the hardness of which is equal to or greater than 80 g/mm$^2$) is used by the printing device, it is difficult for the relative hard or thick paper to bend and deform when the paper outlet is blocked. As a result, not only a consecution delivery of the paper is affected, but also the paper discharging mechanism fails to send out the alarm in time. Therefore, the paper discharging mechanisms of the existing technologies cannot adapt to relative hard or thick paper.

SUMMARY

The present disclosure aims to provide a paper discharging mechanism capable of adapting to relative hard or thick paper, and a printing device having the same.

According to a first aspect of the present disclosure, a paper discharging mechanism is provided. The paper discharging mechanism includes: a frame provided with a paper outlet thereon; a swinging rack, configured to be swingable relative to the frame; a conveying roller assembly provided on the swinging rack; a first drive assembly, which is connected to the conveying roller assembly in a transmission way and configured to drive the same to deliver a paper to the paper outlet; and a first detection assembly, configured to detect a position of the swinging rack relative to the frame. The swinging rack swings in a direction away from the paper outlet when the paper outlet is blocked.

Further, the swinging rack further includes a paper discharging passage disposed between the conveying roller assembly and the paper outlet, the swinging rack has a first position and a second position. An exit end of the paper discharging passage is close to the paper outlet when the swinging rack is at the first position. The exit end of the paper discharging passage is away from the paper outlet when the swinging rack is at the second position. The swinging rack swings to the second position when the paper outlet is blocked.

Further, the first detection assembly includes: a sensor disposed on one of the frame and the swinging rack; and a detection part disposed on the other one of the frame and the swinging rack. The sensor is configured to detect the position of the swinging rack by being matched or separated with the detection part.

Further, the frame further includes a guiding part above the swinging rack. The guiding part is located upstream of the conveying roller assembly in a paper outputting direction. The guiding part has a first side for guiding the paper to enter the conveying roller assembly.

Further, a paper containment space for containing paper is provided at an upstream position of the conveying roller assembly.

Further, the paper discharging mechanism further includes a second drive assembly which is connected to the swinging rack in a transmission way and configured to drive the swinging rack to swing.

Further, the second drive assembly includes a motor and an external gear. One of the motor and the external gear is mounted on the swinging rack, and the other one of the motor and the external gear is mounted on the frame. An output shaft of the motor is provided with a motor gear, and the external gear is engaged with the motor gear.

Further, the frame further includes a bottom plate. The motor is fixedly disposed on the swinging rack, the external gear is fixedly disposed on the bottom plate. The external gear is arranged in a sector having a swinging center of the swinging rack as a circular center, and the central angle of the external gear is equal to or greater than a swinging angle of the swinging rack.

Further, the paper discharging mechanism further includes an elastic component. One end of the elastic component is connected to the frame, and the other end of the elastic component is connected to the swinging rack.

According to a second aspect of the present disclosure, a printing device is provided. The printing device includes: a printing assembly, a cutter assembly, and a paper discharging mechanism sequentially arranged in a paper outputting direction, where the paper discharging mechanism is the paper discharging mechanism of any one of the first aspect of the present disclosure.

According to the paper discharging mechanism and the printing device having the same of the present disclosure, the paper discharging mechanism includes: a frame provided with a paper outlet thereon; a swinging rack, configured to be swingable relative to the frame; a conveying roller assembly provided on the swinging rack; a first drive assembly, which is connected to the conveying roller assembly in a transmission way and configured to drive the conveying roller assembly to deliver a paper to the paper outlet; and a first detection assembly, configured to detect a position of the swinging rack relative to the frame. The swinging rack swings in a direction away from the paper outlet when the paper outlet is blocked. The conveying roller assembly drives the paper to be output via the paper outlet when the paper discharging mechanism operates normally. In the case that the paper outlet is blocked due to human or other factors, as the conveying roller assembly proceeds to convey paper, the swinging rack is pushed by the paper jammed at the paper outlet to conquer a force (e.g. the swinging rack's own gravity or elastic force), which causes the swinging rack to be held at a position where the paper is normally output, so as to swing because the hardness or thickness of the paper is relative high. The first detection assembly detects the position of the swinging rack relative to the frame, and can detect that the paper outlet of the paper discharging mechanism is blocked based on the position of the swinging rack relative to the frame. Therefore, compared with the paper discharging mechanism of the existing technology, the paper discharging mechanism provided by the present disclosure can detect the paper jam in time and effectively even if the hardness or thickness of the paper is relative high.

BRIEF DESCRIPTION OF DRAWINGS

Accompany drawings constituting a part of the present disclosure are used for providing a further understanding of the present disclosure. Exemplary embodiments of the present disclosure and the description thereof are used for explaining the present disclosure, and are not to be construed as improper limiting the present disclosure. In the accompany drawings:

In FIGS. 2~10, various numeral references indicate the following parts respectively:

Figure 1:
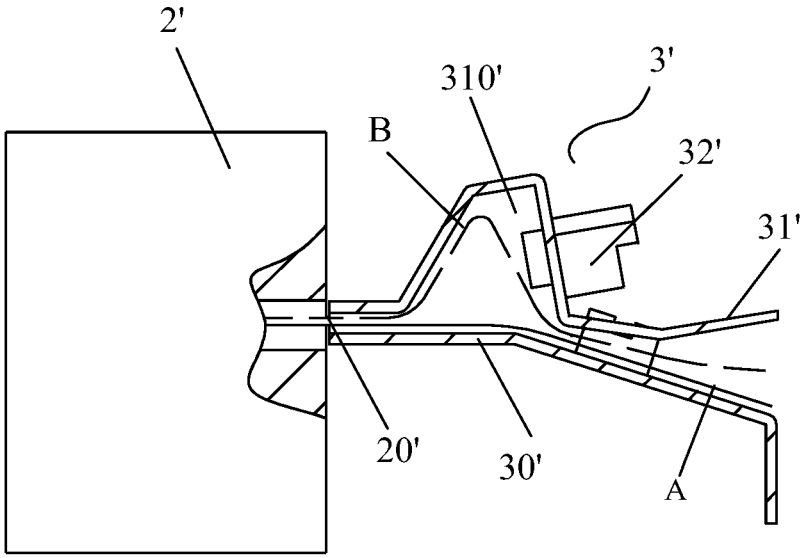
FIG. 1 is a view of a terminal apparatus for preventing paper jam provided by the China patent application No. 200820005246.8.
Figure 2:
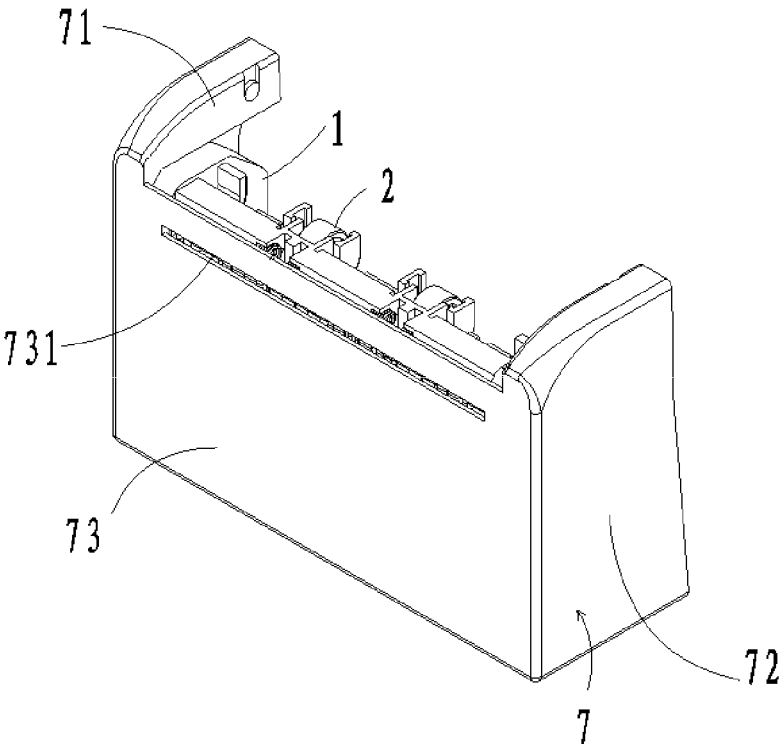
FIG. 2 is a structural view of a paper discharging mechanism according to a first embodiment of the present disclosure.
Figure 3:
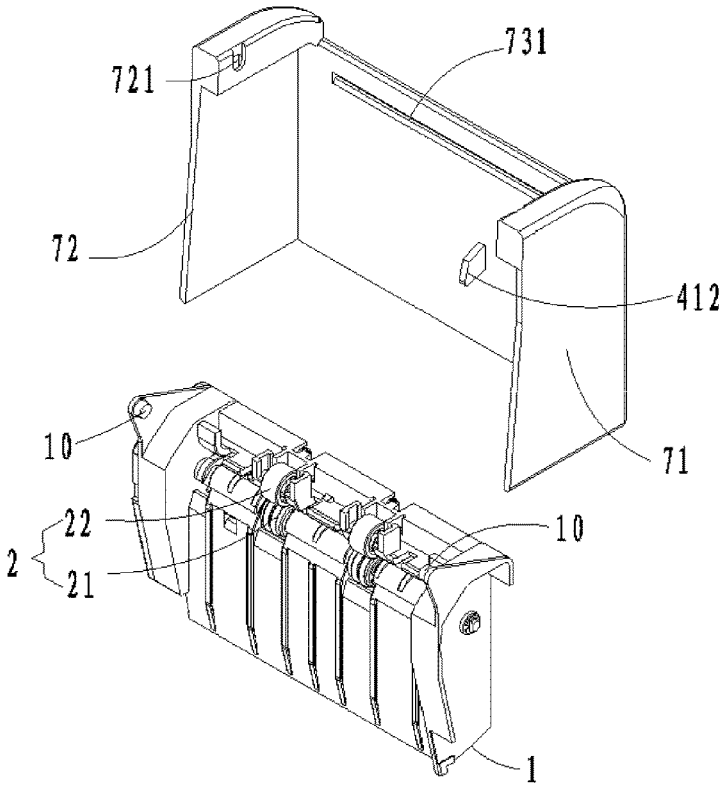
FIG. 3 is an exploded structural view of the paper discharging mechanism according to the first embodiment of the present disclosure.

1 swinging rack; 10 pivot shaft; 111 first passage plate; 112 second passage plate; 11 paper discharging passage; 2 conveying roller assembly; 21 drive roller; 22 driven roller; 41 first detection assembly; 411 sensor; 412 detection part; 42 second detection assembly; 5 first drive assembly; 51 first motor; 52 transfer gear set; 53 platen gear; 511 first motor gear; 521 first gear; 522 second gear; 6 elastic component; 7 frame; 71 left wall; 72 right wall; 721 hole; 73 front wall; 731 paper outlet; 74 top wall; 741 guiding part; 741*a* first side; 741*b* second side; 75 bottom plate; 8 second drive assembly; 81 second motor; 82 external gear; 811 second motor gear; 100 printing assembly; 110 printing head; 120 printing platen; 200 cutter assembly; 210 fixed blade; 220 movable blade; 300 paper discharging mechanism.

DETAILED DESCRIPTION

The present disclosure will be described below in details with reference to accompanying drawings. It is noted that embodiments and features of the embodiments in the present disclosure may be combined with each other in case of no conflict.

It is noted that, the terms used herein are for the purpose of describing particular embodiments only and are not intended to limit explanatory embodiments of the present disclosure. As used herein, singular forms are intended to include plural forms unless otherwise stated in the context. It will be further understood that the terms "includes" and/or "including" used in the description specify the presence of features, steps, operations, elements, components and/or the combination thereof.

For convenient description, relative space position terms, such as "on . . . ", "above . . . ", "at the upper surface of . . . " and the like, may be used herein to describe a space position relationship between one component or feature and another component(s) or feature(s) as illustrated in the figures. It will be understood that the relative space position terms are intended to encompass different orientations of the component in use or operation in addition to the orientation depicted in the figures. For example, if a component in the figures is turned over, the component described as "above" or "on" other components or features would then be oriented as "under or below" other elements or features. Thus, the exemplary term "above . . . " can encompass both an orientation of above and below. The component may be otherwise oriented (rotated 90 degrees or at other orientations) and the spatially relative descriptors used herein are interpreted accordingly.

As shown in FIGS. 2~10, a paper discharging mechanism provided by the present disclosure mainly includes: a frame 7, a swinging rack 1, a conveying roller assembly 2, a first drive assembly 5 and a first detection assembly 41. The frame 7 is provided with a paper outlet 731 thereon. The swinging rack 1 is configured to be swingable relative to the frame 7. The conveying roller assembly 2 is provided on the swinging rack 1. The first drive assembly 5 is in a transmission connection with the conveying roller assembly 2, and configured to drive the conveying roller assembly 2 to deliver paper to the paper outlet 731. The first detection assembly 41 is configured to detect a position of the swinging rack 1 relative to the frame 7. When the paper outlet 731 is blocked, the swinging rack 1 swings in a direction away from the paper outlet 731.

The conveying roller assembly 2 drives the paper to be output through the paper outlet 731 when the paper discharging mechanism operates normally. In the case that the paper outlet 731 is blocked due to human or other factors, as the conveying roller assembly 2 proceeds to convey paper, the swinging rack 1 is pushed by the paper jammed at the paper outlet 731 to conquer a force (e.g. the swinging rack 1's own gravity or elastic force), which causes the swinging rack 1 to be held at a position where the paper is normally output, so as to swing because the hardness or thickness of the paper is relative high. The first detection assembly 41 detects the position of the swinging rack 1 relative to the frame 7, and can detect that the paper outlet 731 of the paper discharging mechanism is blocked based on the position of the swinging rack relative to the frame. Therefore, compared with the paper discharging mechanism of the prior art, the paper discharging mechanism provided by the present disclosure can detect the paper jam timely and effectively even if the hardness or thickness of the paper is relative high.

Preferably, the swinging rack 1 further includes a paper discharging passage 11 disposed between the conveying roller assembly 2 and paper outlet 731. The swinging rack 1 may be at a first position and a second position. An exit end of the paper discharging passage 11 is close to the paper outlet 731 when the swinging rack 1 is located at the first position. The exit end of the paper discharging passage 11 is away from the paper outlet 731 when the swinging rack 1 is located at the second position. The swinging rack 1 swings to the second position when the paper outlet 731 is blocked.

As limited by a height of the paper discharging passage 11, the paper in the paper discharging passage 11 can't be bent or can merely yield a tiny bent when the paper outlet 731 is blocked. Accordingly, as the conveying roller assembly 2 proceeds to convey paper, the paper jammed at the paper outlet 731 may push the swinging rack 1 to swing more timely. Therefore, the problem of paper jam can be detected more timely and effectively.

Preferred embodiments of the present disclosure will be further described in conjunction with FIGS. 2~10.

As shown in FIGS. 2~5, the paper discharging mechanism includes the frame 7, the swinging rack 1, the conveying roller assembly 2, the first detection assembly 41 and the first drive assembly 5. The frame 7 includes a left wall 71, a right wall 72 and a front wall 73. The left wall 71 and the right wall 72 are separately disposed, which are parallel and opposite and a distance therebetween is greater than a maximum width of the paper output by the paper discharging mechanism. The front wall 73 is connected between the left wall 71 and the right wall 72, and is provided with the paper outlet 731 on a surface thereof for discharging paper.

Figure 4:
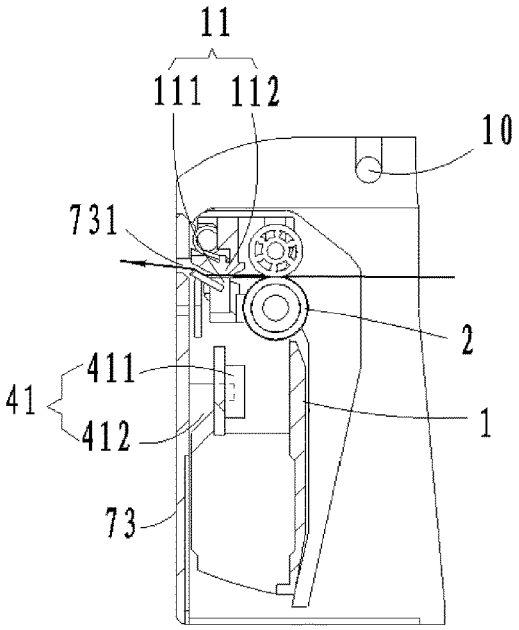
FIG. 4 is a sectional structural view of the paper discharging mechanism according to the first embodiment of the present disclosure, in which a swinging rack is located at a first position.
Figure 5:
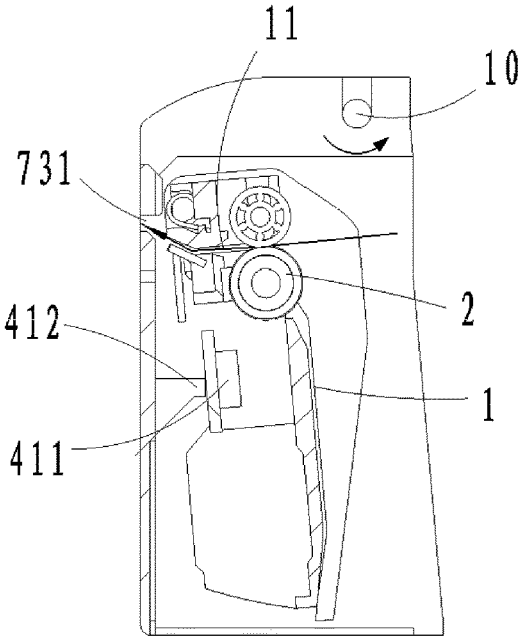
FIG. 5 is a sectional structural view of the paper discharging mechanism according to the first embodiment of the present disclosure, in which the swinging rack is located at a second position.
Figure 7:
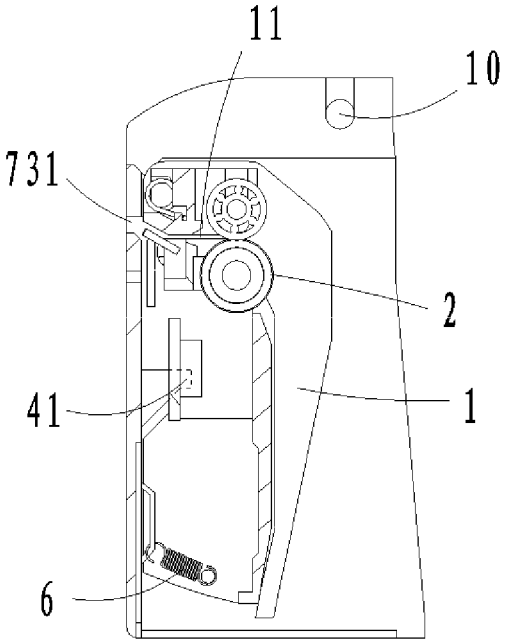
FIG. 7 is a sectional structural view of a paper discharging mechanism according to a second embodiment of the present disclosure.

The swinging rack 1 is pivotally connected to the frame 7 via a pivot shaft 10 and is located inside a space formed by the left wall 71, the right wall 72 and the front wall 73 of the frame 7. The swinging rack 1 may swing around the pivot shaft 10, and may be located at the first position where the swinging rack 1 is against the front wall 73 of the frame 7 (as shown in FIG. 4) and the second position where the swinging rack 1 is separated from the front wall 73 (as shown in FIG. 5). In the present embodiment, each end of the swinging rack 1 in a width direction of the paper is provided with a pivot shaft 10, and the two pivot shafts 10 are coaxially arranged. The axis lines of the two pivot shafts 10 are a swinging center around which the swinging rack 1 swings. The two pivot shafts 10 are pivotally connected to a hole in the left wall 71 of the frame 7 (not shown in the Figure) and a hole 721 in the right wall 72 of the frame 7 respectively, so that the swinging rack 1 can rotate around the axis lines of the pivot shafts 10. The swinging rack 1, under an effect of its own gravity, always has a motion trend of rotating around the pivot shaft 10 towards the front wall 73 until against the front wall 73. Preferably, in another embodiment of the present disclosure, for example a second embodiment as shown in FIG. 7, the paper discharging mechanism further includes an elastic component 6. One end of the elastic component 6 is connected to the frame 7, and the other end is connected to the swinging rack 1. Under an effect of an elastic force of the elastic component 6, the swinging rack 1 always has a motion trend of swinging around the pivot shaft 10 towards the first position.

A first passage plate 111 and a second passage plate 112 are disposed on the swinging rack 1 oppositely and are separately. The paper discharging passage 11 is formed between the first passage plate 111 and the second passage plate 112. The paper discharging passage 11 extends in a paper outputting direction, and has a preset height and a preset width. The height of the paper discharging passage 11 is matched with a maximum thickness of the paper output by the paper discharging mechanism. The width of the paper discharging passage 11 is matched with a maximum width of the paper output by the paper discharging mechanism. An exit end of the paper discharging passage 11 is communicated to the paper outlet 731, thus the paper can be discharged from the paper outlet 731 through the paper discharging passage 11.

The conveying roller assembly 2 is disposed on the swinging rack 1 and is located at an entrance of the paper discharging passage 11 in the paper outputting direction. The conveying roller assembly 2 swings together with the swinging rack 1 when the swinging rack 1 swings around the pivot shaft 10. The conveying roller assembly 2 includes a drive roller 21 and a driven roller 22 tangentially mated with each other. The drive roller 21 is in transmission connection with the first drive assembly 5, and can rotate, driven by the first drive assembly 5, around its own axis line to drive the paper between the drive roller 21 and the driven roller 22 to move.

Preferably, the paper discharging mechanism of the present embodiment further includes a controller. The first detection assembly 41 and the first drive assembly 5 are electrically connected to the controller respectively. The controller controls actions of the first drive assembly 5 according to a detection signal output by the first detection assembly 41.

The first detection assembly 41 is configured to detect the position of the swinging rack 1. The first detection assembly 41 includes a sensor 411 and a detection part 412. The sensor 411 detects the position of the swinging rack 1 by being matched with or separated from the detection part 412. The sensor 411 is disposed on one of the swinging rack 1 and the frame 7, and may be either a photoelectric sensor or a mechanical sensor. The detection part 412 is disposed on the other one of the swinging rack 1 and the frame 7. When the swinging rack 1 is located at the first position, the sensor 411 is matched with the detection part 412 and outputs a first detection signal. When the swinging rack 1 is located at the second position, the sensor 411 is separated from the detection part 412 and outputs a second detection signal. The controller may determine the position of the swinging rack 1 according to the detection signals output by the sensor 411.

In the present embodiment, the detection part 412 is fixedly disposed at the internal side of the front wall 73 of the frame 7. The sensor 411 is a photoelectric sensor. The sensor 411 is fixedly connected to the swinging rack 1. When the swinging rack 1 is located at the first position, the detection part 412 is matched with the sensor 411 and is inserted into a light path of the sensor 411 to block ray propagation, and the sensor 411 outputs the first detection signal. When the swinging rack 1 is located at the second position, the detection part 412 is separated from the sensor 411 and withdrawn from the light path of the sensor 411 so as to keep the light path unblocked, thus the sensor 411 outputs the second detection signal.

Figure 6:
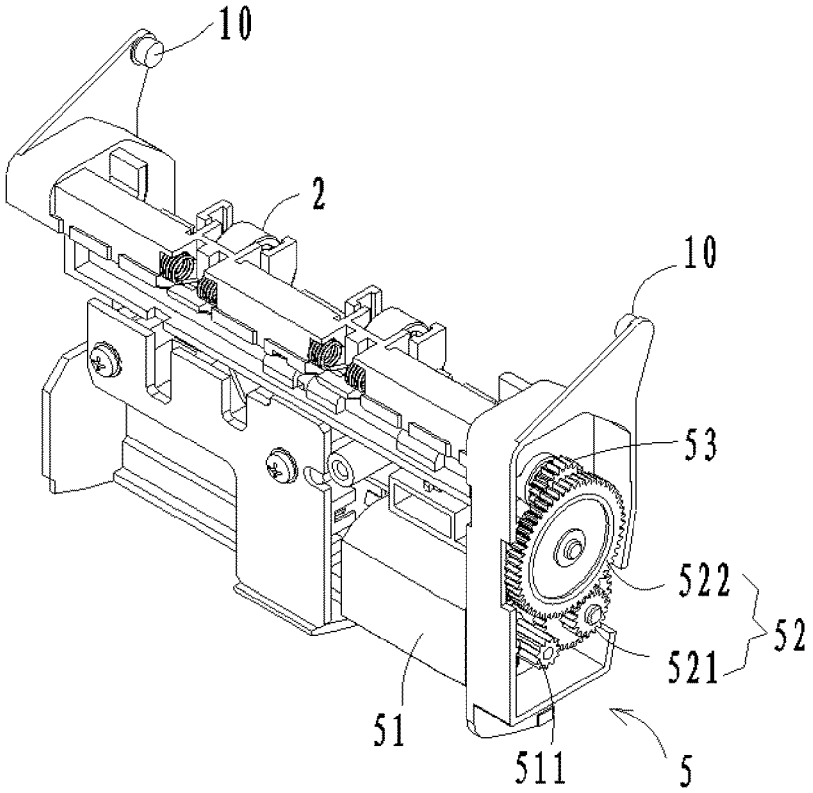
FIG. 6 is an internal structure view of the paper discharging mechanism according to the first embodiment of the present disclosure.

FIG. 6 is an internal structure view of the paper discharging mechanism according to the first embodiment of the present disclosure. As shown in FIG. 6, in the present embodiment, the first drive assembly 5 is configured to drive the drive roller 21 of the conveying roller assembly 2 to rotate, so as to convey paper to the paper outlet 731. The first drive assembly 5 includes a first motor 51, a transfer gear set 52 and a platen gear 53. The first motor 51 is fixedly mounted on the swinging rack 1, and a first motor gear 511 is mounted on an output shaft of the first motor 51. The transfer gear set 52 includes at least one gear for transferring a torque output by the first motor 51 to the platen gear 53. The platen gear 53 is fixedly mounted on a shaft end of the drive roller 21, and is engaged with one gear of the transfer gear set 52. When the output shaft of the first motor 51 rotates, it may drive the platen gear 53 to rotate via the transfer gear set 52, thereby driving the drive roller 21 to rotate. In the present embodiment, the transfer gear set 52 includes a first gear 521 and a second gear 522 engaged with each other. The first gear 521 is further engaged with the first motor gear 511, the second gear 522 is further engaged with the platen gear 53.

An operation process of the paper discharging mechanism provided by the present embodiment is described below.

In the case that the convey state of the paper is normal, the swinging rack 1 is located at the first position due to its' own gravity, the first drive assembly 5 drives the drive roller 21 of the conveying roller assembly 2 so as to drive the driven roller 22 to rotate, thereby driving a paper between the drive roller 21 and the driven roller 22 to move to the paper discharging passage 11 and to be discharged from the paper discharging mechanism via the paper outlet 731. At the moment, the sensor 411 of the first detection assembly 41 outputs the first detection signal.

In the case that the paper is prevented from being discharged from the paper outlet 731 due to a user's or other reason in the paper delivery process, the prevented paper is jammed at the paper outlet 731. However, since the hardness or thickness of the paper is relative high and the height of the paper discharging passage 11 is matched with the maximum thickness of the paper, the paper in the paper discharging passage 11 will not bend and deform or merely yield a tiny bent deformation. Therefore, as the conveying roller assembly 2 proceeds to conveying paper, the swinging rack 1 is pushed by the paper jammed at the paper outlet 731 to conquer the swinging rack's own gravity to swing around the pivot shaft 10 to the second position away from the paper outlet 731. When it is detected that the swinging rack 1 is located at the second position, the sensor 411 of the first detection assembly 41 outputs the second signal, the controller determines that the paper outlet 731 is blocked according to the second signal, sends out an alarm message and notifies the user that the paper delivery is abnormal.

The paper discharging mechanism of the present disclosure includes the frame, the swinging rack pivotally connected to the frame, the conveying roller assembly disposed on the swinging rack, the paper discharging passage disposed between the conveying roller assembly and the paper outlet, and the sensor and the detection part which are disposed on the frame and the swinging rack respectively. The conveying roller assembly drives the paper to pass through the paper discharging passage to be output via the paper outlet when the paper discharging mechanism is normally worked. When the paper outlet is blocked due to a user's or other reason, the paper in the paper discharging passage will not bend or merely yield a tiny bent since the hardness or thickness of the paper is relative high and the paper is limited by the height of the paper discharging passage. Therefore, as the conveying roller assembly proceeds to conveying paper, the swinging rack is pushed by the paper jammed at the paper outlet to conquer the swinging rack's gravity so as to swing, and then the sensor is triggered by the detection part to output a corresponding detection signal, and it is determined based on the detection signal that the paper outlet of the paper discharging mechanism is blocked. Compared with the paper discharging mechanism of the prior art, the paper discharging mechanism provided by the present disclosure can detect the paper jam timely and effectively even if the hardness or thickness of the paper is relative high. Therefore, the paper discharging mechanism provided by the present disclosure is adapted to paper with greater hardness or thickness.

Figure 8:
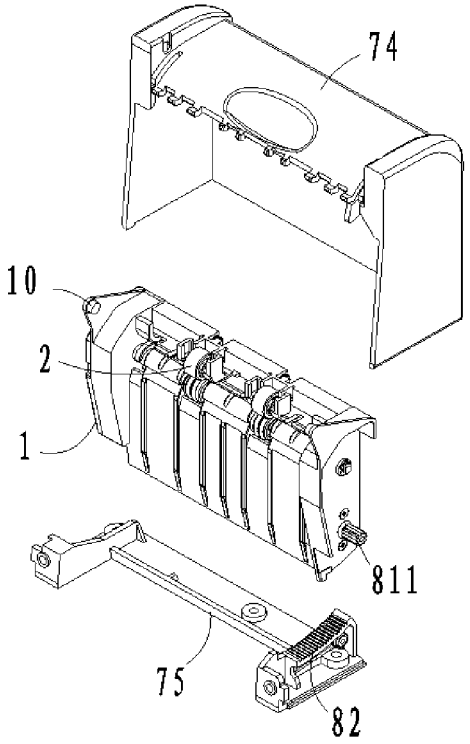
FIG. 8 is an exploded structural view of the paper discharging mechanism according to a third embodiment of the present disclosure.
Figure 9A:
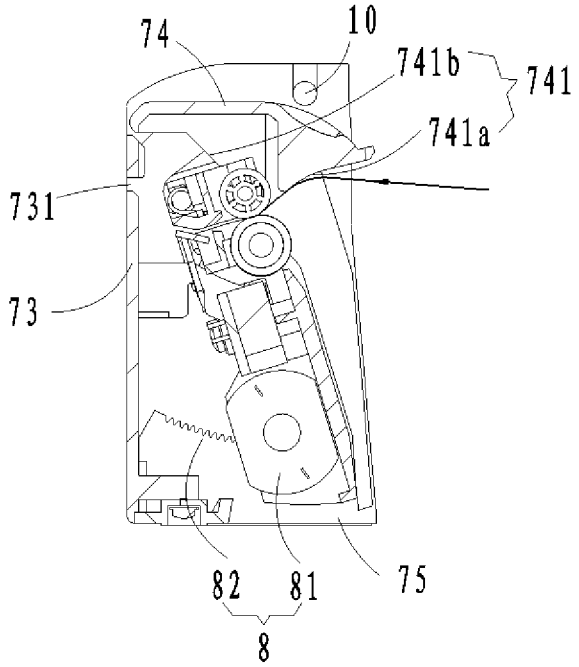
FIG. 9A is a sectional structural view of the paper discharging mechanism of the third embodiment of the present disclosure during paper feeding.

FIG. 8 is an exploded structural view of the paper discharging mechanism according to a third embodiment of the present disclosure. FIG. 9A is a sectional structural view of the paper discharging mechanism of the third embodiment of the present disclosure during paper feeding. As shown in FIGS. 8, 9A, compared with the first embodiment, the paper discharging mechanism in the present embodiment further includes a second drive assembly 8 and a second detection assembly 42. The frame 7 further includes a top wall 74 and a bottom plate 75. A paper accommodation space D for accommodating paper is further provided upstream of the conveying roller assembly 2. The first drive assembly 5 is further configured to drive the paper back to the paper accommodation space D to be stored.

Specifically, the top wall 74 is connected between the left wall 71 and the right wall 72, and is above the swinging rack 1. A guiding part 741 is provided on a side adjacent to the swinging rack 1 of the top wall 74. The guiding part 741 is located upstream of the conveying roller assembly 2 in the paper outputting direction. The guiding part 741 has a first side 741*a* configured to guide the paper to be between the drive roller 21 and the driven roller 22 of the conveying roller assembly 2, and a second side 741*b* configured to guide the paper between the drive roller 21 and the driven roller 22 to be withdrawn from the entrance of the conveying roller assembly 2. The first side 741*a* and the second side 741*b* are positioned in a V-shape.

The second drive assembly 8 is in transmission connection with the swinging rack 1 to drive the swinging rack 1 to swing between the first position and the second position. The second drive assembly 8 includes a second motor 81 and an external gear 82. One of the second motor 8 and the external gear 82 is mounted on the swinging rack 1. For example, preferably, one of the second motor 8 and the external gear 82 may be mounted on an end away from the pivot shaft 10 of the swinging rack 1. The other one of the second motor 81 and the external gear 82 is mounted on the frame 7. An output shaft of the second motor 81 is provided with a second motor gear 811, and the external gear 82 is engaged with the second motor gear 811. When the output shaft of the second motor 81 rotates, the swinging rack 1 may be driven to swing between the first position and the second position by an engagement transmission of the second motor gear 811 and the external gear 82. In the present embodiment, the second motor 81 is fixedly mounted on the swinging rack 1, while the external gear 82 is fixedly disposed on the bottom plate 75 of the frame 7 and is engaged with the second motor gear 811. The external gear 82 is arranged in a sector having a swinging center of the swinging rack 1 (namely the axis center of the pivot shaft 10) as a circular center, and the central angle of the sector is greater than or equal to a swinging angel of the swinging rack 1 between the first position and the second position. When the output shaft of the second motor 81 rotates, the second motor gear 811 rolls relative to the external gear 82 fixedly mounted on the frame 7 so as to drive the swinging rack 1 to swing around the pivot shaft 10.

The second detection assembly 42 is configured to determine whether the paper has been clamped by the conveying roller assembly 2. As shown in FIGS. 9A~9D, the second detection assembly 42 is disposed on a downstream of the conveying roller assembly 2 in the paper outputting direction, and is configured to determine whether the paper has been clamped between the drive roller 11 and the driven roller 12 of the conveying roller assembly 2. The second detection assembly 42 is a mechanical sensor or a photoelectric sensor. The second detection assembly 42 outputs the first detection signal when the paper has not reached the second detection assembly 42; and outputs the second detection signal when the paper has reached the second detection assembly 42.

Preferably, the paper discharging mechanism of the present embodiment further includes a controller communicatively connected to the first detection assembly 41, the second detection assembly 42, the first drive assembly 5 and the second drive assembly 8 respectively. The controller controls actions of corresponding drive assembly according to the detection signal output by each detection assembly.

The operation process of the paper discharging mechanism provided by the present embodiment is described below.

As shown in FIG. 9A, in a standby state, the swinging rack 1 is located at the second position, the first detection assembly 41 outputs the second detection signal, and the second detection assembly 42 outputs the first detection signal. The first side 741*a* of the guiding part 741 guides the paper to be located between the drive roller 21 and the driven roller 22 of the conveying roller assembly 2 when the paper enters the paper discharging mechanism via a paper inlet of the paper discharging mechanism.

Figure 9B:
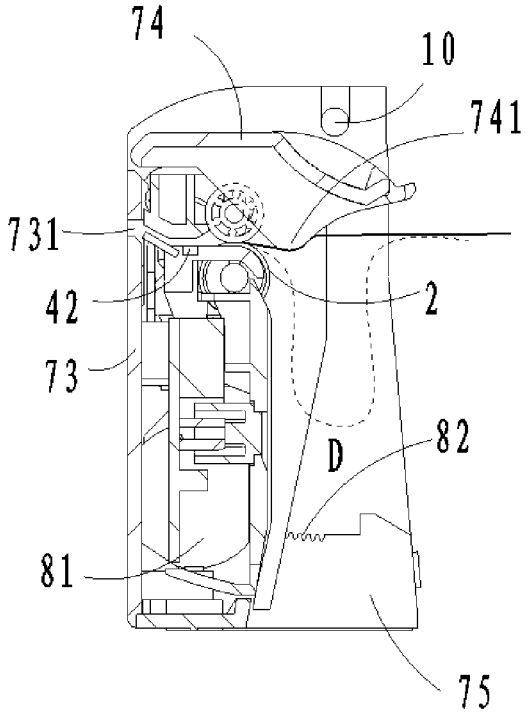
FIG. 9B is a sectional structural view of the paper discharging mechanism of the third embodiment of the present disclosure during paper accommodation.

As shown in FIG. 9B, when the paper deliver mechanism accommodates paper, the controller controls the first motor 51 to drive the drive roller 21 of the conveying roller assembly 2 to rotate in the paper outputting direction, the drive roller 21 and the driven roller 22 drive the paper to move towards the paper outlet 731. When the head of the paper moves to the position of the second detection assembly 42, the second detection assembly 42 outputs the second detection signal. At this moment, the controller controls the output shaft of the first motor 51 to stop rotating, and then the controller controls the output shaft of the second motor 81 to stop rotating after rotating by a preset angle in a preset direction, and the external gear 82 drives the swinging rack 1 to swing from the second position to the first position. When the swinging rack 1 is located at the first position, the first detection assembly 41 outputs the first detection signal, the tangent position between the drive roller 21 and the driven roller 22 of the conveying roller assembly 2 moves accordingly, so that the bottom of V-shape of the guiding part 741 passes through the paper conveying path between the paper inlet of the paper discharging mechanism and the tangent position. Therefore, the paper forms a bend at the bottom of V-shape of the guiding part 741. Meanwhile, if the paper is proceeds to be conveyed, the paper will proceed with bending in a U-shape, and be temporarily stored in a paper accommodation space D opposite to the guiding part 741 and between the left wall 71 and the right wall 72.

Figure 9C:
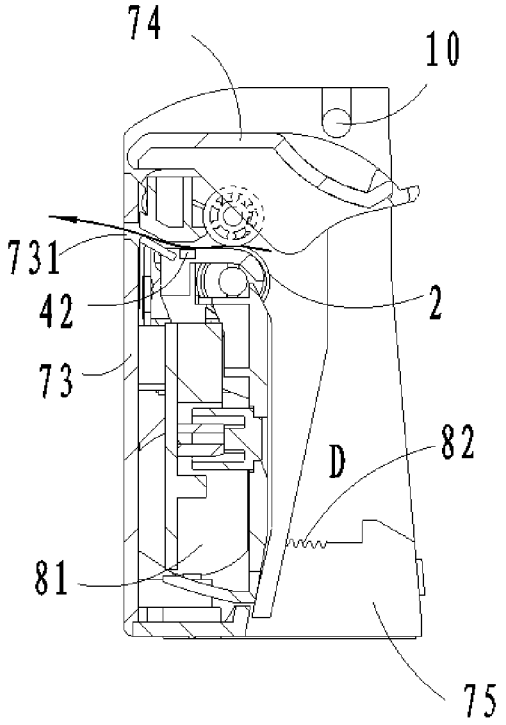
FIG. 9C is a sectional structural view of the paper discharging mechanism of the third embodiment of the present disclosure during paper delivering.

As shown in FIG. 9C, when the paper discharging mechanism discharges paper, the controller controls the first motor 51 to drive the drive roller 21 of the conveying roller assembly 2 to rotate in the paper outputting direction. Then, the controller controls the first motor 51 to stops rotating after the head of the paper is discharged from the paper outlet 731 for a preset distance. At this time, the end of the paper is clamped between the drive roller 21 and the driven roller 22, waiting for the user to take away. If the paper outlet 731 is blocked due to the user or other reason during the paper discharging process of the paper discharging mechanism, the paper will not bend and deform or merely yield a tiny bent deformation because the hardness or thickness of the paper is relative high and the paper is limited by the height of the paper discharging passage. Therefore, the swinging rack 1 is pushed by the paper jammed at the paper outlet 731 to swing to the second position as the conveying roller assembly 2 proceeds to conveying paper. When the first detection assembly 41 outputs the second detection signal, the controller determines that there is a paper jam, and sends out an alarm message to prompt the user that there is a paper jam.

Figure 9D:
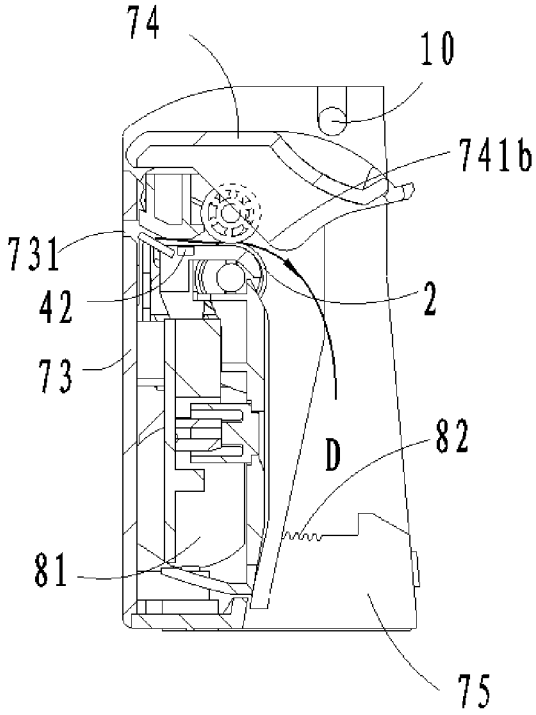
FIG. 9D is a sectional structural view of the paper discharging mechanism of the third embodiment of the present disclosure during paper returning.

As shown in FIG. 9D, after a preset time, if the paper is not taken away by a user, the first motor 51 is controlled by the controller to drive the drive roller 21 of the conveying roller assembly 2 to rotate in a paper return direction opposite to the paper outputting direction. The end of the paper enters the paper accommodation space D to be stored under the guiding of the second side 741*b* of the guiding part 741.

The paper discharging mechanism of the present embodiment further includes the V-shape guiding part and the second drive assembly. The second drive assembly is incorporated to drive the swinging rack to swing between the first position and the second position. The paper is guided by the V-shape guiding part to enter the conveying roller assembly, or return to the paper accommodation space to be stored. Compared with the above embodiments, the paper discharging mechanism provided by the present embodiment has added a paper accommodation function and a returned paper storage function, thus the paper discharging mechanism can avoid the user dragging the paper during paper discharging, and can avoid a problem of information missing when the user forgets to take away the paper.

It is noted that, the above embodiments are not intended to limit the present disclosure. For example, in each embodiment, the swinging rack 1 abuts the front wall 73 when the swinging rack 1 is located at the first position; the swinging rack 1 is separated from the front wall 73 when the swinging rack 1 is located at the second position. In other embodiments which are not illustrated, the first position and the second position may be arranged to be other suitable positions, as long as it can be determined correctly whether the paper delivery is malfunctioning. For another example, in the above embodiments, both the conveying roller assembly 2 and the first drive assembly 5 are disposed on the swinging rack 1 and swing along with the swinging of the swinging rack 1. In other embodiments which are not illustrated, the conveying roller assembly and the first drive assembly may also be fixedly mounted on the frame.

The present disclosure further provides a printing device. The printing device includes a printing assembly, a cutter assembly, and a paper discharging mechanism sequentially arranged in a paper outputting direction. The paper discharging mechanism is the aforementioned paper discharging mechanism.

Figure 10:
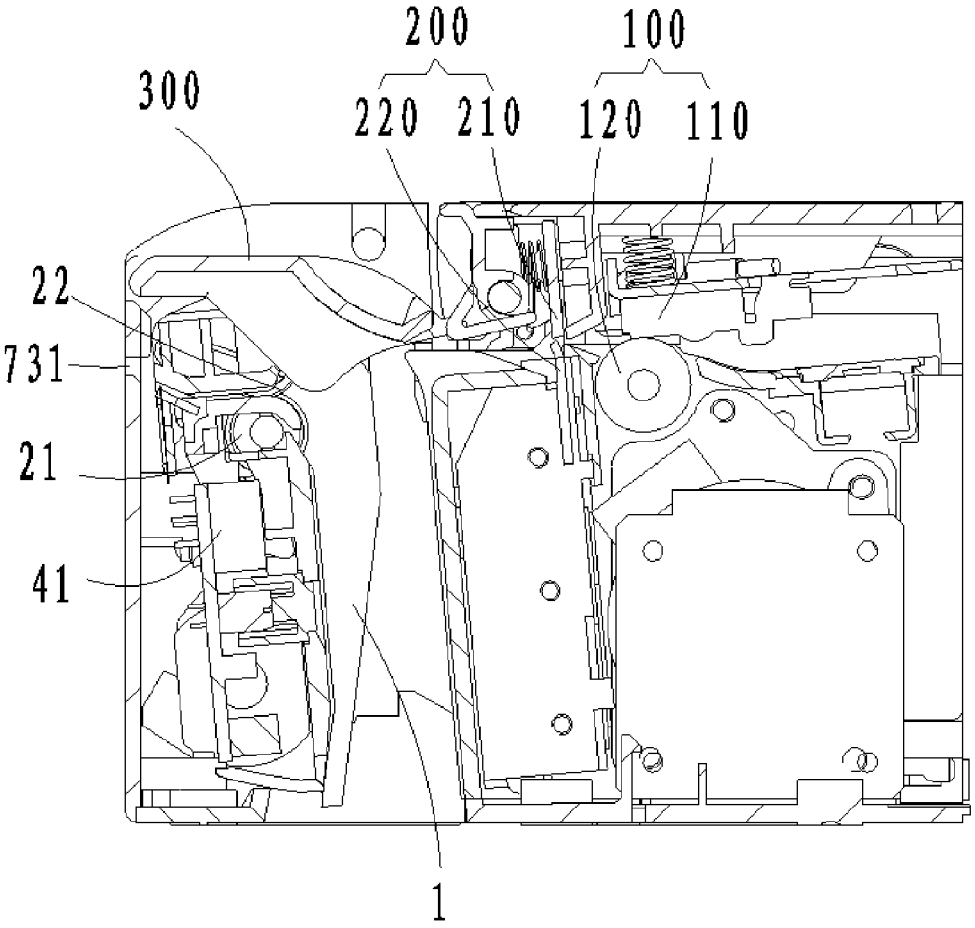
FIG. 10 is a s structural view of an embodiment of a printing device having the paper discharging mechanism provided by the present disclosure.

FIG. 10 is a structural view of an embodiment of a printing device having the paper discharging mechanism provided by the present disclosure. As shown in FIG. 10, the printing device includes a printing assembly 100, a cutter assembly 200, and a paper discharging mechanism 300 sequentially arranged in the paper outputting direction.

The printing assembly 100 is configured to print an image or a character on the paper. In the present embodiment, the printing assembly 100 is a thermal printing assembly, and includes a printing platen 120 and printing heads 110 which are oppositely disposed at two sides of a passage. In other embodiments of the present disclosure, the printing assembly may be a dot impact type, an inkjet type, or a laser type and the like. The arrangement of the conventional printing assembly of the dot impact type, inkjet type and laser type are well known to those skilled in the art and is not very related to the present disclosure, thus the arrangement is omitted herein.

The cutter assembly 200 is configured to cut off the paper being printed. The cutter assembly 200 includes a fixed blade 210 and a movable blade 220 which are oppositely disposed at two sides of the passage. The paper discharging mechanism 300 is configured to temporarily store the paper before the printing is completed, and output the paper after the printing is completed and recycle the paper left by the user. The paper inlet of the paper discharging mechanism 300 is connected to the paper outlet of the cutter assembly 200. The paper discharging mechanism 300 employs the paper discharging mechanism provided by any of the above embodiments and the description of which is not repeated herein.

After a print instruction is received by the printing device, the printing head 110 performs printing on the paper, meanwhile the printing platen 120 drives the paper to move to the cutter assembly 200. After passing between the fixed blade 210 and the movable blade 220 of the cutter assembly 200, the paper enters the paper discharging mechanism 300 via the paper inlet thereof, and is clamped by the drive roller 21 and the driven roller 22 of the paper discharging mechanism 300. The movable blade 220 of the cutter assembly 200 moves towards the fixed blade 210 to cut off the paper that has been printed after the printing assembly 100 finishes printing. The drive roller 21 and the driven roller 22 of the paper discharging mechanism 300 output the paper that has been printed via the paper outlet 731. At this moment, if the paper outlet 731 is blocked due to a user or other reason, the swinging rack 1 of the paper discharging mechanism 300 swings, so that the first detection assembly 41 of the paper discharging mechanism 300 outputs the corresponding detection signal. Accordingly, the controller of the printing device determines that the paper delivery is abnormal according to the detection signal and sends out the alarm information.

The paper discharging mechanism of the present disclosure is employed in the printing device of the present embodiment. Therefore, the problem that the paper is jammed at the paper outlet can be detected timely and effectively even if the hardness or thickness of the paper is relative high. Therefore, the printing device of the present disclosure is especially adapted to paper with greater hardness or thickness.

The aforementioned are merely preferred embodiments of the present disclosure, the present disclosure is not limited to the above embodiments. To those skilled in the art, various changes and modifications can be made to the present disclosure. Various modifications substitutions and improvements can be made thereto without departing from the spirit and scope of the present disclosure as set forth in the appended claims.

What is claimed is:

1. A paper discharging mechanism, comprising:

a frame provided with a paper outlet;

a swinging rack, configured to be swingable relative to the frame;

a conveying roller assembly provided on the swinging rack;

a first drive assembly, being in a transmission connection with the conveying roller assembly and configured to drive the conveying roller assembly to convey a paper to the paper outlet; and a first detection assembly, configured to detect a position of the swinging rack relative to the frame, wherein the swinging rack swings in a direction away from the paper outlet when the paper outlet is blocked, and the conveying roller assembly is configured to swing together with the swinging rack, wherein the conveying roller assembly comprises: a drive roller and a driven roller tangentially mated with each other; the drive roller is configured to drive the paper between the drive roller and the driven roller to move.

2. The paper discharging mechanism of claim 1, wherein the swinging rack comprises a paper discharging passage disposed between the conveying roller assembly and the paper outlet, the swinging rack has a first position and a second position, wherein an exit end of the paper discharging passage is close to the paper outlet when the swinging rack is located at the first position; the exit end of the paper discharging passage is away from the paper outlet when the swinging rack is located at the second position; and the swinging rack swings to the second position when the paper outlet is blocked.

3. The paper discharging mechanism of claim 2, further comprising: an elastic component, wherein one end of the elastic component is connected to the frame, and the other end of the elastic component is connected to the swinging rack.

4. The paper discharging mechanism of claim 1, wherein the first detection assembly comprises:

a sensor disposed on one of the frame and the swinging rack; and a detection part disposed on the other one of the frame and the swinging rack, wherein the sensor is configured to detect the position of the swinging rack by being matched with or separated from the detection part.

5. The paper discharging mechanism of claim 4, further comprising: an elastic component, wherein one end of the elastic component is connected to the frame, and the other end of the elastic component is connected to the swinging rack.

6. The paper discharging mechanism of claim 1, wherein the frame further comprises a guiding part above the swinging rack, the guiding part is located upstream of the conveying roller assembly in a paper outputting direction, wherein the guiding part has a first side for guiding the paper to enter the conveying roller assembly.

7. The paper discharging mechanism of claim 1, wherein a paper accommodation space for accommodating paper is provided upstream of the conveying roller assembly.

8. The paper discharging mechanism of claim 1, further comprising a second drive assembly, wherein the second drive assembly is in a transmission connection with the swinging rack and configured to drive the swinging rack to swing.

9. The paper discharging mechanism of claim 8, wherein the second drive assembly comprises a second motor and an external gear, wherein one of the motor and the external gear is mounted on the swinging rack, and the other one of the motor and the external gear is mounted on the frame, an output shaft of the second motor is provided with a second motor gear, and the external gear is engaged with the motor gear.

10. The paper discharging mechanism of claim 9, wherein the frame further comprises a bottom plate, the second motor is fixedly mounted on the swinging rack, the external gear is fixedly disposed on the bottom plate, the external gear is arranged in a sector having a swinging center of the swinging rack as a circular center, and a central angle of the external gear is equal to or greater than a swinging angle of the swinging rack.

11. The paper discharging mechanism of claim 1, further comprising: an elastic component, wherein one end of the elastic component is connected to the frame, and the other end of the elastic component is connected to the swinging rack.

12. A printing device, comprising: a printing assembly, a cutter assembly, and a paper discharging mechanism sequentially arranged in a paper outputting direction, wherein the paper discharging mechanism comprises:

a frame provided with a paper outlet;

a swinging rack, configured to be swingable relative to the frame;

a conveying roller assembly provided on the swinging rack;

a first drive assembly, being in a transmission connection with the conveying roller assembly and configured to drive the conveying roller assembly to convey a paper to the paper outlet, and a first detection assembly, configured to detect a position of the swinging rack relative to the frame, wherein the swinging rack swings in a direction away from the paper outlet when the paper outlet is blocked, and the conveying roller assembly is configured to swing together with the swinging rack, wherein the conveying roller assembly comprises: a drive roller and a driven roller tangentially mated with each other; the drive roller is configured to drive the paper between the drive roller and the driven roller to move.

13. The printing device of claim 12, wherein the swinging rack comprises a paper discharging passage disposed between the conveying roller assembly and the paper outlet, the swinging rack has a first position and a second position, wherein an exit end of the paper discharging passage is close to the paper outlet when the swinging rack is located at the first position; the exit end of the paper discharging passage is away from the paper outlet when the swinging rack is located at the second position; and the swinging rack swings to the second position when the paper outlet is blocked.

14. The printing device of claim 12, wherein the first detection assembly comprises:

a sensor disposed on one of the frame and the swinging rack; and a detection part disposed on the other one of the frame and the swinging rack, wherein the sensor is configured to detect the position of the swinging rack by being matched with or separated from the detection part.

15. The printing device of claim 12, wherein the frame further comprises a guiding part above the swinging rack, the guiding part is located upstream of the conveying roller assembly in a paper outputting direction, wherein the guiding part has a first side for guiding the paper to enter the conveying roller assembly.

16. The printing device of claim 12, wherein a paper accommodation space for accommodating paper is provided at upstream of the conveying roller assembly.

17. The printing device of claim 12, wherein the paper discharging mechanism further comprises a second drive assembly, wherein the second drive assembly is in a transmission connection with the swinging rack and configured to drive the swinging rack to swing.

18. The printing device of claim 17, wherein the second drive assembly comprises a motor and an external gear, wherein one of the motor and the external gear is mounted on the swinging rack, and the other one of the motor and the external gear is mounted on the frame, an output shaft of the motor is provided with a motor gear, and the external gear is engaged with the motor gear.

19. The printing device of claim 18, wherein the frame further comprises a bottom plate, the motor is fixedly mounted on the swinging rack, the external gear is fixedly disposed on the bottom plate, the external gear is arranged in a sector having a swinging center of the swinging rack as a circular center, and a central angle of the external gear is equal to or greater than a swinging angle of the swinging rack.

20. The printing device of claim 18, wherein the paper discharging mechanism further comprises an elastic component, wherein one end of the elastic component is connected to the frame, and the other end of the elastic component is connected to the swinging rack.

* * * * *